United States Patent [19]

Vago et al.

[11] Patent Number: 5,020,512

[45] Date of Patent: Jun. 4, 1991

[54] WATER HEATER CONSTRUCTION AND METHOD OF HEATING WATER

[75] Inventors: Otto Z. Vago, Burns; Ernest Wenczl, Nashville, both of Tenn.

[73] Assignee: State Industries, Inc., Ashland City, Tenn.

[21] Appl. No.: 65,140

[22] Filed: Jun. 24, 1987

Related U.S. Application Data

[63] Continuation of Ser. No. 639,195, Aug. 9, 1984, abandoned.

[51] Int. Cl.[5] ..... F24H 1/00

[52] U.S. Cl. ..... 126/350 R; 126/362; 126/364; 126/315; 126/314; 126/316; 126/312; 122/17; 122/156

[58] Field of Search ..... 126/362, 364, 365, 345, 126/360 R, 350 R, 315, 314, 307 R, 316, 312; 122/17, 20 A, 20 B, 82 R, 182 S, 156, 161, 180, 122, 121

[56] References Cited

U.S. PATENT DOCUMENTS

| | | | |
|---|---|---|---|
| 3,091,223 | 5/1963 | Vitale | 126/307 R |
| 3,662,735 | 5/1972 | Jackson | 126/307 R X |
| 3,707,142 | 12/1972 | Kobayashi | 122/17 |
| 4,541,410 | 9/1985 | Jatana | 126/362 |

*Primary Examiner*—Carl D. Price

*Attorney, Agent, or Firm*—Paul R. Puerner

[57] ABSTRACT

A water heater including a water tight tank having a tank wall and top and bottom head members welded thereto. A combustion chamber and burner are mounted beneath the bottom head. A pair of concentrically arranged jacket members are mounted around the tank wall with the space between the jacket members serving as a flow passageway through which combustion air flows downwardly to the combustion chamber. A pair of concentrically arranged tube assemblies are connected to the top of the heater. The inside tube assemblies carry products of combustion from the heater and the space between the inside tube assemblies and the outside tube assemblies serve as a flow passageway through which combustion air flows to the flow passageway space between the jacket members.

13 Claims, 4 Drawing Sheets

WATER HEATER CONSTRUCTION AND METHOD OF HEATING WATER

This is a continuation of copending application Ser. No. 639,195, filed on Aug. 9, 1984, now abandoned.

BACKGROUND OF THE INVENTION

1. Field of the Invention

This invention relates to water heaters and a method of heating water More particularly, it related to a gas (or oil) fired water heater wherein the products of combustion flow directly from the heater through an exterior wall to the outside of the space in which the heater is installed and the combustion air flows directly from outside the space in which the water heater is installed through an enclosed passageway to a combustion chamber for the heater.

2. Description of the Prior Art

The present water heater, by utilizing combustion air drawn directly from outside and preheating such combustion air, results in increased efficiency. Also, by directing flow of the combustion air in a 360° fashion around the exterior surface of the inner jacket and the inner surface of the outer jacket, pilot outage due to excessive drafts is substantially reduced. Also, such combustion air space surrounding the tank wall provides additional insulation to the water in the tank to thereby reduce standby heat loss. To applicant's knowledge, the above stated advantages are not found in any prior art water heaters.

SUMMARY OF THE INVENTION

A water heater including a water tight tank means having a tank wall and top and bottom members welded thereto. A combustion chamber is located beneath the bottom head member and a burner means is mounted in the combustion chamber. A flue tube extends upwardly in the tank means for conducting products of combustion from the combustion chamber to a vent tube. A combustion products vent tube is provided for conducting products of combustion from the flue tube directly to the outside through an exterior wall in the space in which the water heater is installed. A combustion air transmission means is provided for conducting combustion air directly from outside through the exterior wall in the space in which the water heater is installed. Such transmission means includes a first air passage space formed between a first jacket member mounted around and spaced from the tank wall and a second jacket member mounted around and spaced from the first jacket member. The first and second jacket members are concentrically arranged with the space therebetween constituting such first air passage space through which combustion air flows downwardly to the combustion chamber.

DESCRIPTION OF THE PREFERRED EMBODIMENT

Figure 1:
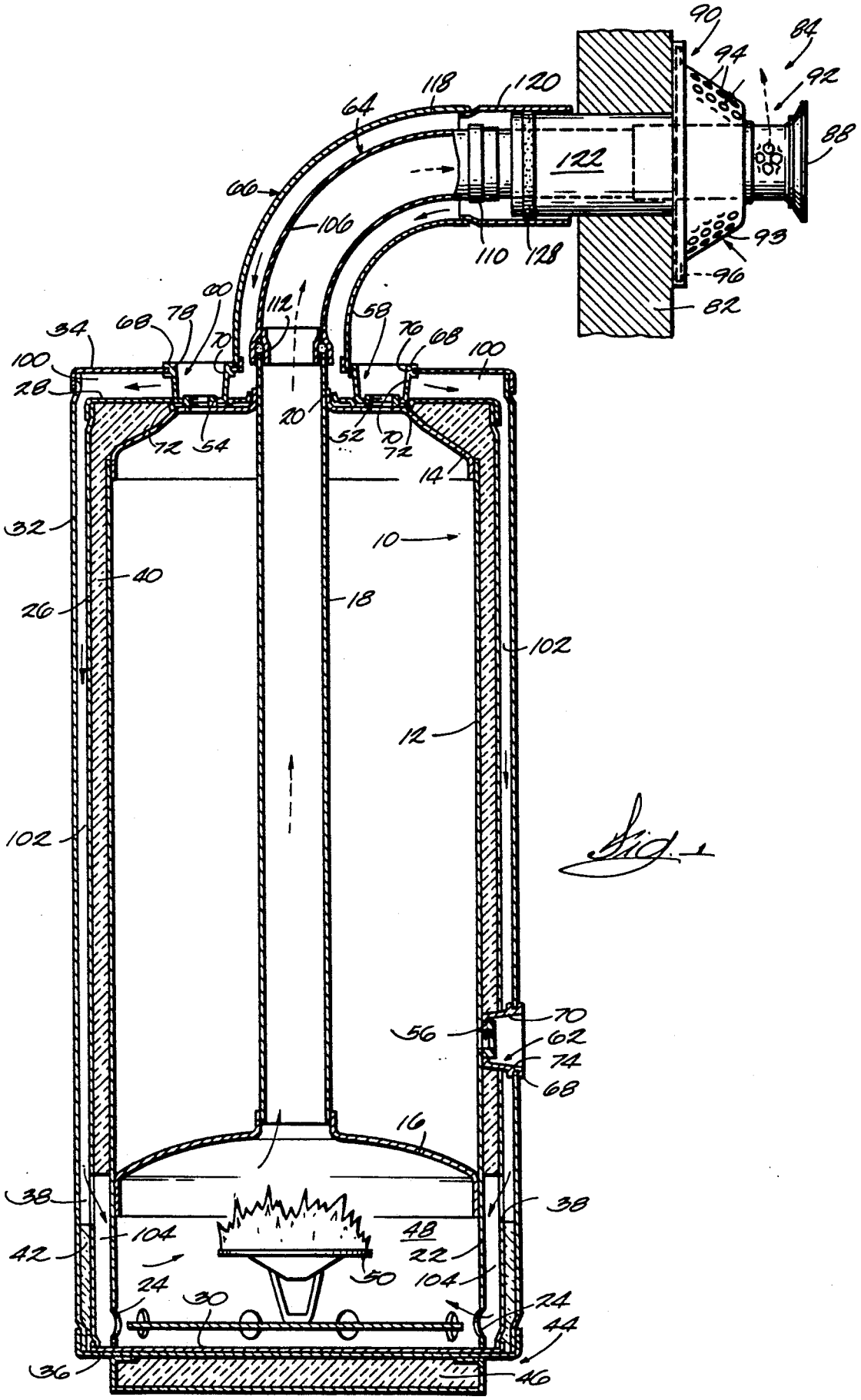
FIG. 1 is a side elevation view of a water heater made in accordance with the present invention.

The water heater of the present invention includes a liquid tight tank 10 comprised of a tank wall 12 and top and bottom head members 14 and 16 welded thereto. The tank 10 further includes a central flue tube 18 welded to bottom head 16 and extending upwardly through an opening 20 in top head 14, to which it is welded.

The tank has a skirt member 22 fastened to the bottom of tank wall 12. The skirt has a plurality of openings 24 spaced around the lower periphery thereof, the function of which will be explained in detail hereinafter. Skirt member 22 in effect becomes an extension of tank wall 12.

Positioned around and spaced from tank wall 12 is a first jacket member 26 having top and bottom members 28 and 30 fastened thereto. First jacket member 26 has a plurality of openings 38 spaced around the lower periphery thereof, the function of which will be explained in detail hereinafter.

Positioned around and spaced from first jacket member 26 is a second jacket member 32 having top and bottom members 34 and 36 fastened thereto.

The space between tank wall 12 and first jacket member 26 above openings 38 and the space between tank top 14 and jacket top 28 is filled with a suitable insulation material designated by reference numeral 40.

The space between first jacket member 26 and second jacket member 32 below openings 38 is filled with a suitable insulation material designated by reference numeral 42.

The water heater assembly described above is mounted on a base assembly 44, the interior of which is filled with a suitable insulation material designated by the reference numeral 46.

A combustion chamber 48 is located beneath bottom head 16 and a gas (or oil) fired burner 50 of a suitable design is mounted in the combustion chamber.

The water heater tank 10 is provided with an inlet fitting 52, an outlet fitting 54 and a drain fitting 56. Specially designed circular non-metallic diaphragm members 58, 60 and 62 are mounted around fittings 52, 54 and 56.

Figure 4:
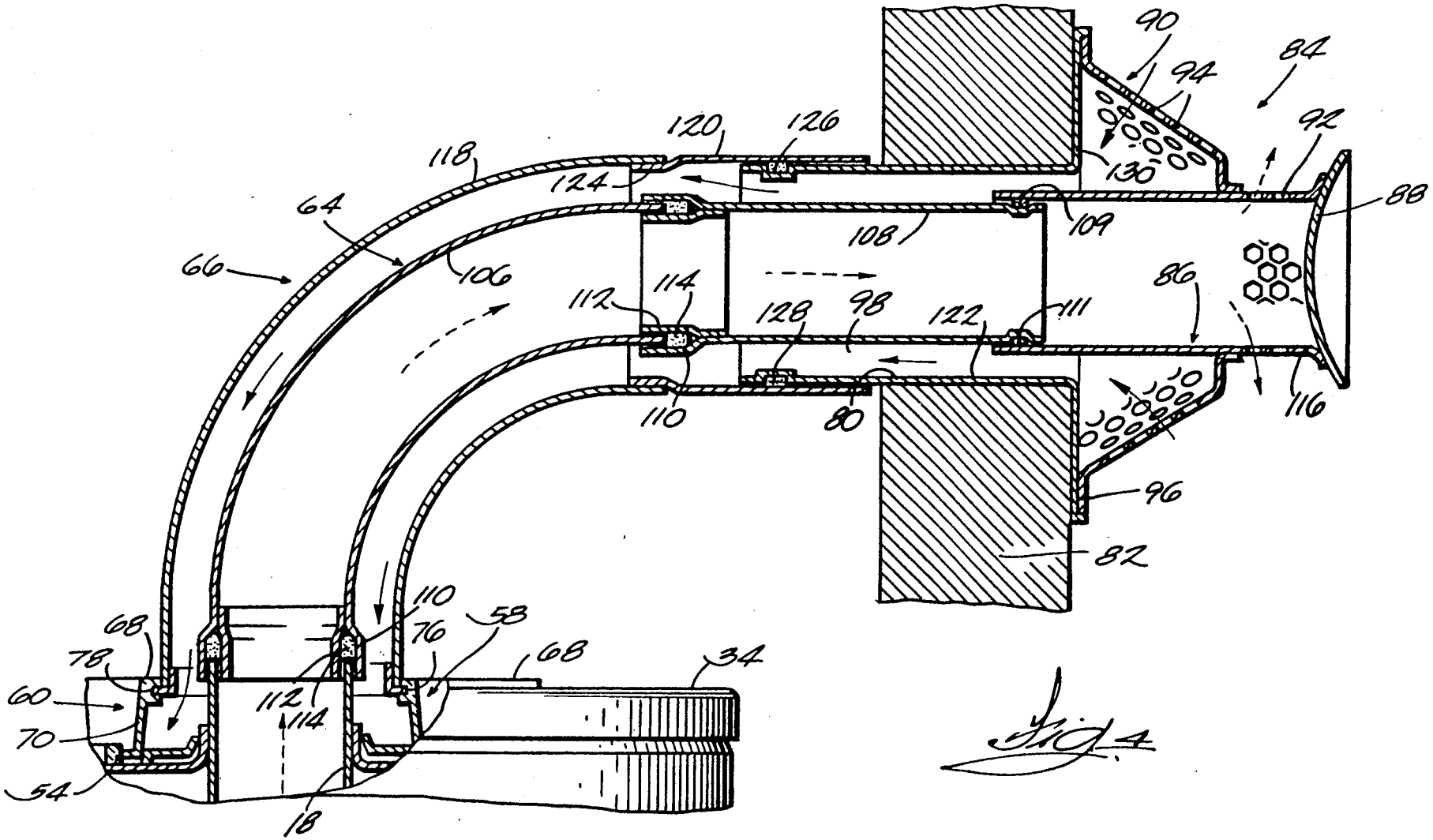
FIG. 4 is a detailed view of the vent tube and combustion air inlet tube assembly.

As best shown in FIGS. 1 and 4, central flue tube 18 is connected to a vent outlet assembly 64 and jacket top member 34 is connected to a combustion air inlet assembly 66.

Diaphragm members 58, 60 and 62 are of identical design, each including a grooved upper flange 68, a conical body portion 70 and a sealing tail portion 72.

Tail portion 72 of diaphragm member 62 is sealed against fitting 56 and the flange 68 is seated in an opening 74 in second jacket member 32. Tail portion 72 of diaphragm member 58 is sealed against fitting 52 and the flange 68 is seated in an opening 76 in top member 34. The tail portion 72 of diaphragm member 60 is sealed against fitting 54 and the flange 68 is seated in an opening 78 in top member 34.

Figure 2:
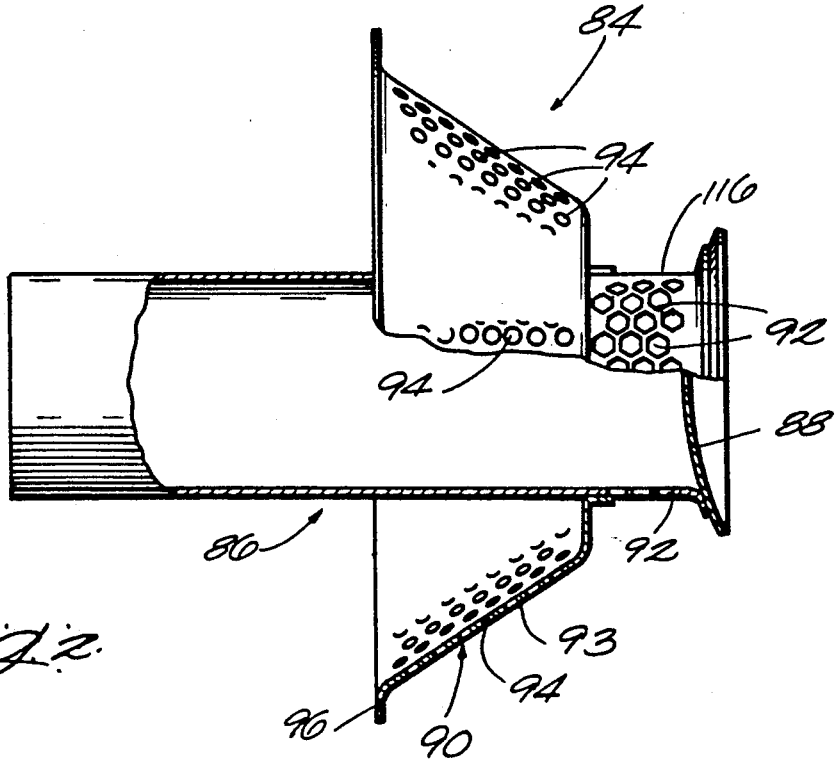
FIG. 2 is an enlarged partially fragmentary view of the vent cap assembly.
Figure 3:
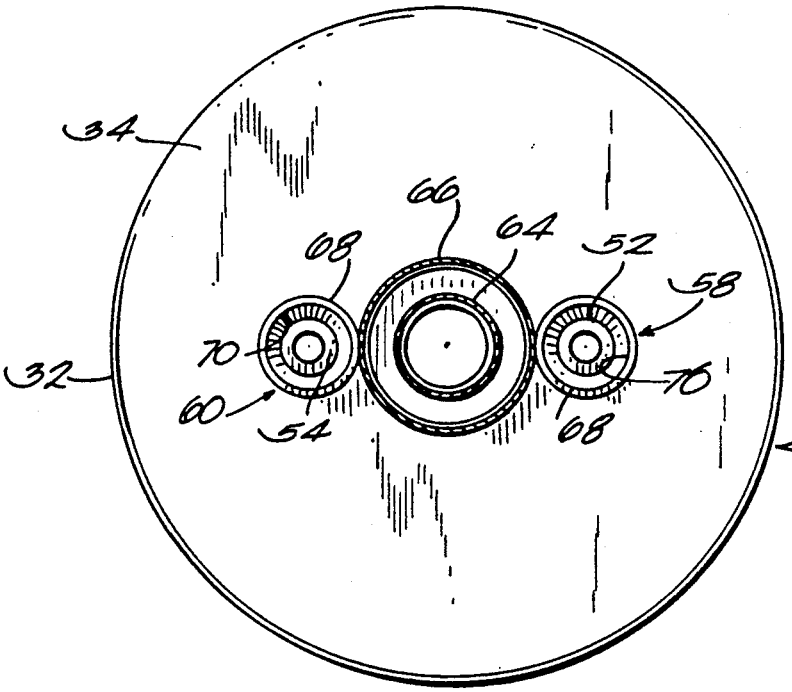
FIG. 3 is a sectional view taken along line 3—3 of FIG. 1.

Referring to FIGS. 2, 3 and 4, vent outlet assembly 64 is comprised of a curved tubular section 106 and a straight tubular section 108. The joints between one end of section 106 and tube 18 and the other end of section 106 and section 108 are the same. Each joint is comprised of an outwardly flared end portion 110 on the tube itself and an inwardly flared member 112 fitted in the ends of tubes 106, 108 with a friction fit. A high temperature gasket material 114 is positioned between the flared portions 110 and 112.

A vent cap assembly 84 is shown in detail in FIG. 2 and is comprised of a vent exhaust tube 86, a wind deflector 88 fastened over the end of tube 86, and an air intake grill member 90 mounted on the exterior of tube 86. Attached to the end of tube 86 is a separate screen member 116 having perforations 92 therein. The wall 93 of grill member 90 is perforated as indicated by reference numeral 94. FIG. 2 shows only representative portions of perforations 92 and 94.

Straight tubular section 108 is provided with a groove 109 in the end thereof in which an o-ring type sealing member 111 is seated. Section 108 is telescopically inserted into vent exhaust tube 86 with o-ring 111 serving to seal the joint between the two sections.

Combustion air inlet assembly 66 is comprised of a curved tubular section 118, a first straight tubular section 120 and a second straight tubular section 122. Curved section 118 is connected at one end to top member 34. Section 120 has an inwardly flared end 124 which is frictionally fitted into the end of section 118. Section 122 is provided with a groove 126 in the end thereof in which sealing compound material 128 is captured. Section 122 extends through opening 80 in wall 82 and is telescopically inserted into section 120 with sealing compound material 128 serving to seal the joint between the two sections. Section 122 is provided with a flange 130 for the purpose of fastening section 122 to the exterior of wall 82 by suitable fasteners (not shown).

It will be appreciated from the above description of vent outlet assembly 64, combustion air inlet assembly 66 and vent cap assembly 84, that the horizontal spacing of the water heater relative to wall 82 can be readily adjusted to a degree by virtue of the telescopic relationship between vent sections 108 and 86 and combustion air sections 120 and 122. The structure described facilitates installation of the water heater.

Figure 6:
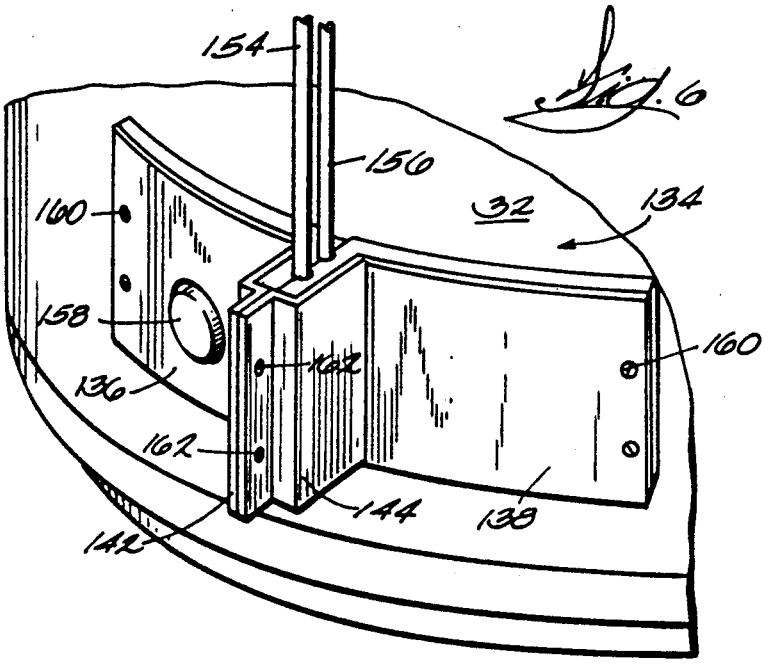
FIG. 6 is a perspective view of the access door assembly in its assembled position.
Figure 5:
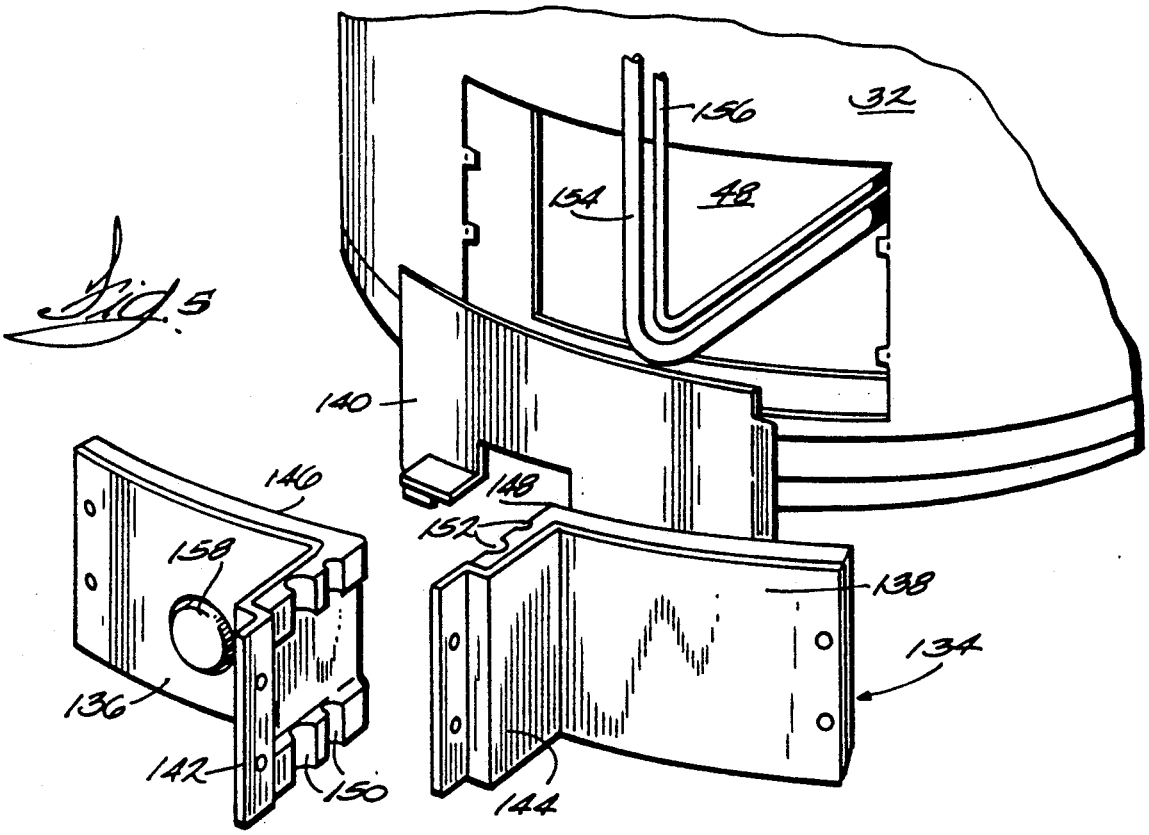
FIG. 5 is an exploded perspective view showing the water heater access door assembly.

FIGS. 5 and 6 show the access door assembly for the water heater. As best shown in FIG. 5, the combustion chamber 48 of the water heater is provided with a removable access door assembly 134 comprised of mating door members 136, 138. A heat shield member 140 fits behind the door members 136, 138 when in assembled position.

Door members 136, 138 are provided with outwardly extending flange portions 142, 144. Gasket portions 146, 148 are provided on the inside surface of door members 136, 138 and flange portions 142, 144. Such gasket portions 146, 148 are provided with grooves 150, 152 to allow the door members to fit snugly around gas lines 154, 156. Gas lines 154, 156 are connected to a thermostatic control unit (not shown) of conventional design Door member 136 is provided with a viewing window 158.

FIG. 6 shows the access door assembly 134 in its assembled position. As thus shown, the door members are removably fastened to the jacket 32 by fasteners 160 and the flange portion 142, 144 on the doors are fastened together by fasteners 162. The door assembly when assembled as shown in FIG. 6 will effectively seal the combustion chamber 48 from the space in which the water heater is installed.

OPERATION

In operation, combustion air from the outside of the building in which the water heater is installed is drawn in through the perforations 94 in grill member 90. Such combustion air flows through the space 98 between the concentrically arranged vent outlet and combustion air inlet assemblies 64 and 66. From there, the combustion air flows radially across the top of the water heater through the space 100 between jacket top members 28 and 34. Diaphragm members 58 and 60 prevent leakage of air at inlet and outlet fittings 52 and 54.

The combustion air continues to flow downwardly through space 102 between concentrically arranged first and second jacket members 26 and 32. Diaphragm member 62 prevents leakage of air at drain fitting 56.

From space 102, the combustion air flows through openings 38 in first jacket member 26 into the space 104 between first jacket member 26 and skirt member 22. From space 104, the combustion air flows through openings 24 in skirt 22 into the combustion chamber 48. Skirt 22, together with jacket members 26 and 32, serves to seal combustion chamber 48 from air entering directly therein from any source other than through vent cap assembly 84. The flow of combustion air as described above is illustrated by the solid arrows shown in FIG. 1.

The combustion air flowing into the combustion chamber 48 supports combustion at burner 50. The products of combustion from burner 50 flow upwardly from chamber 48 into flue tube 18. Such products of combustion flow upwardly through flue tube 18, then through vent outlet assembly 64 and then out to atmosphere through perforations 92. The flow of products of combustion as described above is illustrated by the dotted arrows in FIG. 1.

The water heater construction and operation as described above provides several advantages. First, the use of combustion air derived from outside the building does not affect the temperature conditions prevailing in the space in which the water heater is installed, i.e., warm air is not removed from such space during the heating season and cold air is not removed from such space during the cooling season.

The combustion air flowing past the external surface of vent outlet assembly 64 and past the external surface of first jacket member 26 will be preheated, resulting in increased efficiency. Conversely, the products of combustion flowing through vent outlet assembly 64 will be cooled to thereby permit such products of combustion to be vented directly to the outside without the requirement of a conventional chimney.

Finally, by directing flow of the combustion air downwardly to combustion chamber 48 around the exterior surface of first jacket member 26, the problem of pilot outage due to excessive drafts is substantially reduced. Also, such combustion air space 102 surrounding jacket 26 provides additional insulation to the water in tank 10 to thereby reduce standby heat loss.

We claim:

1. A water heater comprising:

a water tight tank means including a tank wall and top and bottom head members welded thereto;

a combustion chamber located beneath said bottom head member;

a burner means mounted in said combustion chamber;

a flue tube means extending upwardly in said water tight tank means for conducting products of combustion from said combustion chamber up through said top head member;

combustion products vent means connected directly to said flue tube means for conducting the products of combustion from said flue tube means directly to the outside through an exterior wall in the space in which the water heater is installed;

combustion air transmission means for conducting combustion air directly from outside through an exterior wall in the space in which the water heater is installed to said combustion chamber, said combustion air transmission means including a first air passage space between a first jacket member mounted around and spaced from said tank wall and a second jacket member mounted around and spaced from said first jacket member, said first and second jacket members being concentrically arranged with the space therebetween constituting said first air passage space, said space between said first jacket member and said tank wall filled with insulation material.

2. A water heater according to claim 1 in which said combustion products vent means includes a vent outlet assembly connected to the upper end of said flue tube means and extending into an opening in the exterior wall.

3. A water heater according to claim 2 in which said combustion air transmission means includes a combustion air inlet assembly concentrically arranged around the exterior of said vent outlet assembly to provide a second air passage space through which combustion air flows.

4. A water heater according to claim 3 in which there is a vent cap assembly means communicating with both said combustion products vent means and said combustion air transmission means, said vent cap assembly means including a flue vent exhaust tube telescopically connected at one end to said vent outlet assembly and communicating with the atmosphere at the other end.

5. A water heater according to claim 4 in which said vent cap assembly means further includes a perforated grill member mounted on the exterior of said flue vent exhaust tube through which combustion air flows from the outside atmosphere into said combustion air inlet assembly.

6. A water heater according to claim 4 in which said combustion air inlet assembly includes a pair of tubular members telescopically connected to each other.

7. A water heater according to claim 1 in which said first jacket member has a plurality of openings therein through which combustion air flows from said first air passage space to said combustion chamber.

8. A water heater according to claim 7 in which there is a skirt member mounted below said tank wall and spaced inwardly from said first jacket member, said skirt member forming an extension of said tank wall and having a plurality of openings spaced around the periphery thereof through which combustion air flows into said combustion chamber.

9. A water heater according to claim 3 in which said first and second jacket members have spaced apart top members fastened to the tops of said jacket members, said combustion air inlet assembly in communication with said space between said top members, said space between said top members constituting a third air passage space through which combustion air flows.

10. A water heater according to claim 1 in which there is an access opening to said combustion chamber and an access door means removably mounted over said access opening, said access door means including a sealing member means for sealing said access door means to said second jacket member when said access door means is mounted over said access opening.

11. A water heater comprising:

a water tight tank means including a tank wall and top and bottom head members welded thereto, said top head member having an inlet and an outlet fitting welded thereto;

a combustion chamber located beneath said bottom head member;

a burner means mounted in said combustion chamber;

a flue tube means extending upwardly in said water tight tank means for conducting products of combustion from said combustion chamber up through said top head member;

combustion products vent means connected directly to said flue tube means for conducting the products of combustion from said flue tube means directly to the outside through an exterior wall in the space in which the water heater is installed;

combustion air transmission means for conducting combustion air directly from outside through an exterior wall to said combustion chamber, said combustion air transmission means including a first air passage space between a first jacket member mounted around and spaced from said tank wall and a second jacket member mounted around and spaced from said first jacket member, said first and second jacket members being concentrically arranged with the space therebetween constituting said first air passage space, said combustion air transmission means further including a second air passage space formed by a pair of top members fastened to the tops of said first and second jacket members, said space between said top members constituting said second air passage space through which combustion air flows, said space between said first jacket member and said tank wall filled with insulation material; and a pair of diaphragm members mounted around said inlet and outlet fittings to prevent leakage of combustion air from said second air passage space.

12. A water heater according to claim 11 in which said combustion products vent means includes a vent outlet assembly connected to the upper end of said flue tube means and extending into an opening in the exterior wall.

13. A water heater according to claim 12 in which said combustion air transmission means includes a combustion air inlet assembly concentrically arranged around the exterior of said vent tube to provide a second air passage space through which combustion air flows.

* * * * *